US007078685B2

(12) United States Patent
Takada et al.

(10) Patent No.: US 7,078,685 B2
(45) Date of Patent: Jul. 18, 2006

(54) MASS SPECTROMETER

(75) Inventors: Yasuaki Takada, Kiyose (JP); Hisashi Nagano, Hino (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/873,107

(22) Filed: Jun. 23, 2004

(65) Prior Publication Data

US 2005/0067565 A1 Mar. 31, 2005

(30) Foreign Application Priority Data

Sep. 30, 2003 (JP) ..... 2003-339157

(51) Int. Cl.
*H01J 49/00* (2006.01)
*H01J 49/42* (2006.01)

(52) U.S. Cl. ..... 250/292; 250/290; 250/291; 250/293; 250/281; 250/282; 250/283; 250/285

(58) Field of Classification Search ..... 250/290–293, 250/281–283, 285
See application file for complete search history.

(56) References Cited

U.S. PATENT DOCUMENTS

| | | | | |
|---|---|---|---|---|
| 5,196,699 | A * | 3/1993 | Kelley | 250/282 |
| 5,206,507 | A | 4/1993 | Kelley | |
| 5,324,939 | A * | 6/1994 | Louris et al. | 250/292 |
| 5,654,542 | A | 8/1997 | Schubert et al. | |
| 6,114,691 | A * | 9/2000 | Cousins | 250/282 |
| 6,533,544 | B1 * | 3/2003 | Tiemann et al. | 415/191 |
| 6,649,911 | B1 * | 11/2003 | Kawato | 250/293 |
| 6,815,673 | B1 * | 11/2004 | Plomley et al. | 250/292 |
| 6,894,276 | B1 * | 5/2005 | Takada et al. | 250/292 |
| 2002/0027195 | A1 | 3/2002 | Kato | |
| 2002/0195559 | A1 * | 12/2002 | Miseki | 250/292 |
| 2003/0122071 | A1 * | 7/2003 | Plomley et al. | 250/292 |
| 2003/0189168 | A1 * | 10/2003 | Londry et al. | 250/282 |
| 2003/0189171 | A1 * | 10/2003 | Londry et al. | 250/292 |
| 2003/0213908 | A1 * | 11/2003 | Umemura | 250/292 |
| 2004/0061966 | A1 * | 4/2004 | Berger et al. | 360/73.03 |
| 2004/0222369 | A1 * | 11/2004 | Makarov et al. | 250/281 |
| 2005/0006580 | A1 * | 1/2005 | Hager | 250/292 |
| 2005/0067565 | A1 * | 3/2005 | Takada et al. | 250/292 |
| 2005/0151073 | A1 * | 7/2005 | Kato | 250/287 |

FOREIGN PATENT DOCUMENTS

| | | |
|---|---|---|
| EP | 1 319 945 A1 | 9/2000 |
| JP | 7-85834 | 9/1993 |
| JP | 7-134970 | 11/1993 |
| JP | 2000-162189 | 11/1998 |

* cited by examiner

*Primary Examiner*—John R. Lee
*Assistant Examiner*—Bernard E. Souw
(74) *Attorney, Agent, or Firm*—Reed Smith LLP; Stanley P. Fisher, Esq.; Juan Carlos A. Marquez, Esq.

(57) ABSTRACT

A mass spectrometer capable of analysis at high speed and high accuracy comprising a device for applying a high frequency signal not containing resonance frequencies for plural precursor ions but containing resonance frequencies of other ions, and having different amplitudes on every frequencies to an electrode constituting the mass spectrometer thereby controlling the selection for the plural precursor ions, and a device for applying a high frequency signal having amplitudes set individually on every resonance frequencies of the plural precursor ions and superimposed with the resonance frequencies for the plural precursor ions to the electrode constituting the mass spectrometer thereby controlling the dissociation of the plural precursor ions, and judging the presence or absence of the aimed chemical substance based on the mass spectra of the obtained by dissociating the plural fragment ions.

4 Claims, 8 Drawing Sheets

(a) AMPLITUDE OF RF SIGNAL APPLIED TO THE RING ELECTRODE
(b) AMPLITUDE OF RF SIGNAL APPLIED TO THE ENDCAP ELECTRODES

MASS SPECTROMETER

CLAIM OF PRIORITY

The present application claims priority from Japanese Application JP 2003-339157 filed on Sep. 30, 2003, the content of which is hereby incorporated by reference into this application.

FIELD OF THE INVENTION

The present invention relates to a mass spectrometer for judging the presence or absence of an aimed chemical substance and more particularly to a dangerous material detection apparatus for detecting dangerous materials such as explosives or drugs.

BACKGROUND OF THE INVENTION

Along with worsening international conflictions, detection apparatus for detecting explosives have been demanded for preventing terrorism or keeping security. As the detection apparatus, security check apparatus using X-ray transmission have been used generally including airports. X-ray detection apparatus recognize a target as a lump and judge a dangerous target based on the information for the shape and the like thereof and this is referred to as bulk detection. On the other hand, a detection method based on gas analysis is referred to as trace detection, which identifies the substance based on the information of chemical analysis. The trace detection has a feature capable of detecting a trace amount of ingredients deposited on a bag, etc. In view of the a social demand for strict security check, it has been demanded for an apparatus in combination of bulk detection and trace detection thereby capable of detecting dangerous target at a higher accuracy.

On the other hand, for finding illicit drugs carried on various routes, the detection apparatus are used, for example, also in the custom office or the like. While the bulk detection apparatus and drug detecting dogs are mainly used in the custom offices, it has been keenly demanded for a trace analysis apparatus for use in absolute drugs instead of drug-sniffing dogs.

For trace detection, various analysis methods such as ion mobility spectroscopy and gas chromatography have been attempted. Research and development have been under progress for the apparatus having high speed, sensitivity together and selectivity which are important for the detection apparatus.

In view of the situations described above, since mass spectroscopy is basically excellent in the speed, the sensitivity and the selectivity, a detection technique based, for example, on the mass spectroscopy has been proposed (refer to Patent Document 1 (JP-A No. 134970/1995): prior art 1).

FIG. 9 is a view showing the constitution of a dangerous target detection apparatus of the prior art 1. The existent detection apparatus based on the mass spectroscopy is to be described with reference to FIG. 9. An air intake probe 1 is connected by way of an insulative pipe 2 to an ion source 3, and the ion source 3 is connected by way of an exhaust port 4 and an insulative pipe 5 to a pump 6 for use in air exhaustion. The ion source 3 comprises a needle electrode 7, a first aperture electrode 8, an intermediate pressure section 9 and a second aperture electrode 10. The needle electrode 7 is connected with a power source 11. The first aperture electrode 8 and the second aperture electrode 10 are connected with an ion acceleration power source 12. The intermediate pressure section 9 is connected by way of an exhaust port 13 with a vacuum pump, not shown. An electrostatic lens 14 is located subsequent to the intermediate pressure section 9, and a mass analysis section 15 and a detector 16 are disposed subsequent to the electrostatic lens 14. A detection signal from the detector 16 is supplied through an amplifier 17 to a data processing section 18.

The data processing section 18 judges plural m/z (ion mass number/ion valence number) values showing a specified chemical and judges whether the specified chemical is contained or not in a gas to be tested. The data processing section 18 comprises a mass judging section 101, a chemical A judging section 102, a chemical B judging section 103, a chemical C judging section 104 and an alarm driving section 105. Further, display sections 106, 107 and 108 are disposed to an alarm display section 19 driven by the alarm driving section 105.

Further, for monitoring chemical substances, it has been known a method of conducting tandem mass analysis simultaneously in case where plural species of molecules to be measured present (refer to Patent Document 2 (JP-A No. 162189/2000): prior art 2).

Further, in a method of leaving aimed ions in the inside of an ion trap mass spectrometer while discharging other ions, a method of applying a signal having different amplitudes depending on frequencies between end gap electrodes has been known (refer to Patent Document 3 (U.S. Pat. No. 5,654,542): prior art 3).

Further, it has been known a method of deflecting and converging ions by a double cylindrical deflector comprising an inner cylindrical electrode and an outer cylindrical electrode (refer to Patent Document 4 (JP-A No. 85834/1995): prior art 4).

Further, a mass analysis method using filtered noise fields has also been known (refer to Patent Document 5 (U.S. Pat. No. 5,206,507): prior art 5).

The detection apparatus described in the prior art 1 involves the following problems. In the detection apparatus described in the prior art 1, a drug is judged by using an m/z value of an ion generated from the ion source. Accordingly, in a case where a chemical substance generating an ion having an identical m/z value with that of the chemical as a target of detection is present, it has a high possibility of causing erroneous information of indicating alarm irrespective of the absence of the drug to be detected.

More specifically, during detection of a stimulant drug in a luggage, the apparatus reacts to the components of cosmetics contained in the luggage to generate erroneous information. This is attributable to that the selectivity of the mass spectrometric section for analyzing ions is low and it cannot distinguish the ion derived from the stimulant and the ion derived from the cosmetics that incidentally has an identical m/z value.

As method of enhancing the selectivity in the mass spectrometer, a tandem mass analysis method has been known, a triple quadrupole mass spectrometer or a quadrupole ion trap mass spectrometer has been used for an apparatus to practice the tandem mass analysis. In the tandem mass analysis method, the following steps (1) to (4) have usually been used.

(1) First Step Mass Analysis:

Mass analysis is conducted to measure m/z for ions generated from an ion source.

(2) Selection:

An ion having a specified m/z value is selected from the ions having various m/z.

(3) Dissociation:

Selected ion (precursor ion) is dissociated by collision with a neutral gas or the like to generate an ion decomposition product (fragment ion).

(4) Second Step Mass Analysis:

In a case where the precursor ion is dissociated, it depends on the strength of chemical bonds of each site. Accordingly, when the fragment ion is analyzed, a mass spectrum highly abound in molecular structure information of the precursor ion is obtained. Accordingly, even when the ions generated from the ion source incidentally have identical m/z, the target to be detected can be distinguished by checking the mass spectrum of the fragment ions and it can be judged more exactly where the target to be inspected is contained or not.

Accordingly, in the detection apparatus of the prior art 1 shown in FIG. 9, when the mass spectrometric section 15 is replaced with a triple quadrupole ion trap mass spectrometer or quadrupole ion trap mass spectrometer and the tandem mass analysis method is conducted, it can be expected for the development of a detection apparatus capable of improving the selectivity and decreasing the occurrence of erroneous information. However, since the tandem pass analysis method takes a more time compared with usual mass analysis methods, it brings about a new subject that a detection speed required for the detection apparatus cannot be obtained.

With the reasons described above, it has been demanded for a detection apparatus having both high selectivity and high detection speed.

In the tandem mass analysis, when the technique described in the prior art 2 of dissociating plural ions simultaneously is applied, it can be expected for the development of a detection apparatus having both high selectivity and high detection speed but it brings about the following problems.

For example, in a case of detecting explosives, chemical properties of explosives as the target for detection, for example, easiness of dissociation and molecular weight are versatile. Then, more deliberate care is necessary compared with a case of simultaneously measuring only the targets having easiness of dissociation and molecular weight such as chrolophenols and dioxines. For example, when plural explosives are dissociated under identical conditions, since the efficiency of the dissociation changes greatly on every explosives, it results in a problem that a specific explosive cannot be detected effectively.

Further, for obtaining good detection result with less erroneous information, it is necessary to finely set the amplitude of a high frequency applied to the end gap also in a case of selecting plural ions. This is because some explosives are dissociated already in the course of selection. A device as described in the prior art 3 of applying a greater amplitude for a lower frequency was not yet sufficient.

SUMMARY OF THE INVENTION

The present invention intends to provide a mass spectrometer capable of conducting analysis at high speed and high accuracy, as well as an dangerous material detecting apparatus using the same.

According to the present invention, plural precursor ions are selected, and the selected plural precursor ions are dissociated all at once under suitable conditions. In the invention, when tandem mass analysis is conducted for once to plural ions at the same time, high speed and accurate detection is enabled by providing a condition suitable to the detection of the dangerous material.

The mass spectrometer according to the invention comprises a sample introduction section for introducing a sample, an ion source for ionizing the sample introduced from the sample introduction section, an ion trap mass spectrometer for mass spectrometry of ions generated from the ion source, and a data processing device having a data base for chemical substances and judging the presence or absence of an aimed chemical substance based on the mass spectral information obtained by the mass spectrometer. The data base for chemical substances contains mass spectra.

The mass spectrometer according to the invention comprises a device for applying a high frequency signal not containing resonance frequencies for plural precursor ions but containing resonance frequencies of other ions, and having different amplitudes on every frequencies to an electrode constituting the mass spectrometer thereby controlling the selection for the plural precursor ions, and a device for applying a high frequency signal having amplitudes set individually on every resonance frequencies of the plural precursor ions and superimposed with the resonance frequencies for the plural precursor ions to the electrode constituting the mass spectrometer thereby controlling the dissociation of the plural precursor ions (first constitution). Other ions mean, hereinafter, ions other than the plural precursor ions (selected ions). The electrode constituting the mass spectrometer includes a ring electrode and endcap electrodes sandwiching the same.

The mass spectrometer according to the invention comprises a device for applying a high frequency signal not containing resonance frequencies for plural precursor ions but containing resonance frequencies of other ions, and having different amplitudes on every frequencies to an electrode constituting the mass spectrometer thereby controlling the selection for the plural precursor ions, and a device for applying a high frequency signal superimposed with the resonance frequencies for the plural precursor ions to the electrode constituting the mass spectrometer thereby controlling the dissociation of the plural precursor ions (second constitution).

The mass spectrometer according to the invention comprises a device for applying a high frequency signal not containing resonance frequencies for plural precursor ions but containing resonance frequencies of other ions to an electrode constituting the mass spectrometer thereby controlling the selection for the plural precursor ions, and a device for applying a high frequency signal having amplitudes set individually on every resonance frequencies of the plural precursor ions and superimposed with the resonance frequencies for the plural precursor ions to the electrode constituting the mass spectrometer thereby controlling the dissociation of the plural precursor ions (third constitution).

The mass spectrometer according to the invention comprises a device for applying a high frequency signal not containing resonance frequencies for plural precursor ions but containing resonance frequencies of other ions to an electrode constituting the mass spectrometer thereby controlling the selection for the plural precursor ions, and a device for applying a high frequency signal superimposed with the resonance frequencies for the plural precursor ions to the electrode constituting the mass spectrometer thereby controlling the dissociation of the plural precursor ions (fourth constitution).

The mass spectrometer according to the invention comprises a device for applying a high frequency signal not containing resonance frequencies for plural precursor ions but containing resonance frequencies of other ions thereby controlling the selection for the plural precursor ions, and a device for applying a high frequency signal superimposed with the resonance frequencies for the plural precursor ions to the electrode constituting the mass spectrometer thereby controlling the dissociation of the plural precursor ions, and means for switching previously registered plural analyzing conditions sequentially to conduct measurement (fifth constitution).

The mass spectrometer according to the first to fifth constitutions of the invention is based on the identical basic principle of mass spectroscopy of selecting plural precursor ions, obtaining mass spectra of plural fragment ions obtained by dissociating the selected plural precursor ions at the same time and judging the presence or absence of the aimed chemical substance based on the mass spectra of the obtained plural fragment ions.

The dangerous material detection apparatus according to the invention has a feature in detecting dangerous materials such as explosives and absolute drugs by using the mass spectrometer having any of the first to fifth constitutions of the invention described above.

The method of detecting dangerous materials according to the invention comprises a step of ionizing a sample, a selection step of applying a high frequency signal not containing resonance frequencies for plural precursor ions but containing resonance frequencies for other ions to an electrode constituting an ion trap mass spectrometer, thereby selecting the plural precursor ions, a dissociation step of applying a high frequency signal superimposed with resonance frequencies for the plural precursor ions to an electrode constituting the mass spectrometer thereby dissociating the plural precursors, a measuring step of measuring the mass spectra of the plural fragment ions generated by the dissociation of the plural precursor ions by the ion trap mass spectrometer, and a judging step of judging the absence or presence of an aimed chemical substance contained in the sample based on the comparison between the data base for the chemical substances containing the mass spectra and the mass spectra of the obtained plural fragment ions.

Further, the dangerous material detection method according to the invention has the following features.

(1) The dangerous material detection method comprises applying, in the dissociation step, a high frequency signal having amplitudes set individually on every resonance frequencies of the plural precursor ions and superimposed with the resonance frequencies for the plural precursor ions to the electrode constituting the mass spectrometer.

(2) The dangerous material detection method comprises applying, in the selection step, a high frequency signal not containing resonance frequencies for plural precursor ions but containing resonance frequencies of other ions, and having different amplitudes on every frequencies to an electrode constituting the mass spectrometer.

(3) The dangerous material detection method comprises applying, in the selection step, a high frequency signal not containing resonance frequencies for plural precursor ions but containing resonance frequencies of other ions, and having different amplitudes on every frequencies to an electrode constituting the mass spectrometer thereby controlling the selection for the plural precursor ions, and in the dissociation step, a high frequency signal having amplitudes set individually on every resonance frequencies of the plural precursor ions and superimposed with the resonance frequencies for the plural precursor ions to the electrode constituting the mass spectrometer.

(4) The dangerous material detection method comprises switching, in the selection step and in the dissociation step, the conditions for the selection and the dissociation of the plural precursor ions sequentially to previously registered plural analysis conditions thereby conducting the measuring step and the judging step repetitively.

The invention can provide a mass spectrometer capable of analysis at high speed and at high accuracy, and a dangerous material detection apparatus and a dangerous material detection method using the same. According to the invention, the detection speed can be shortened while keeping the high selectivity of the tandem mass analysis as it is, thereby enabling for detection at high speed and high accuracy.

BRIEF DESCRIPTION OF THE DRAWINGS

Preferred embodiments of the present invention will be described in details based on the drawings, wherein.

DESCRIPTION OF PREFERRED EMBODIMENTS OF THE INVENTION

A preferred embodiment of the present invention is to be described in details with reference to the drawings.

Figure 1:
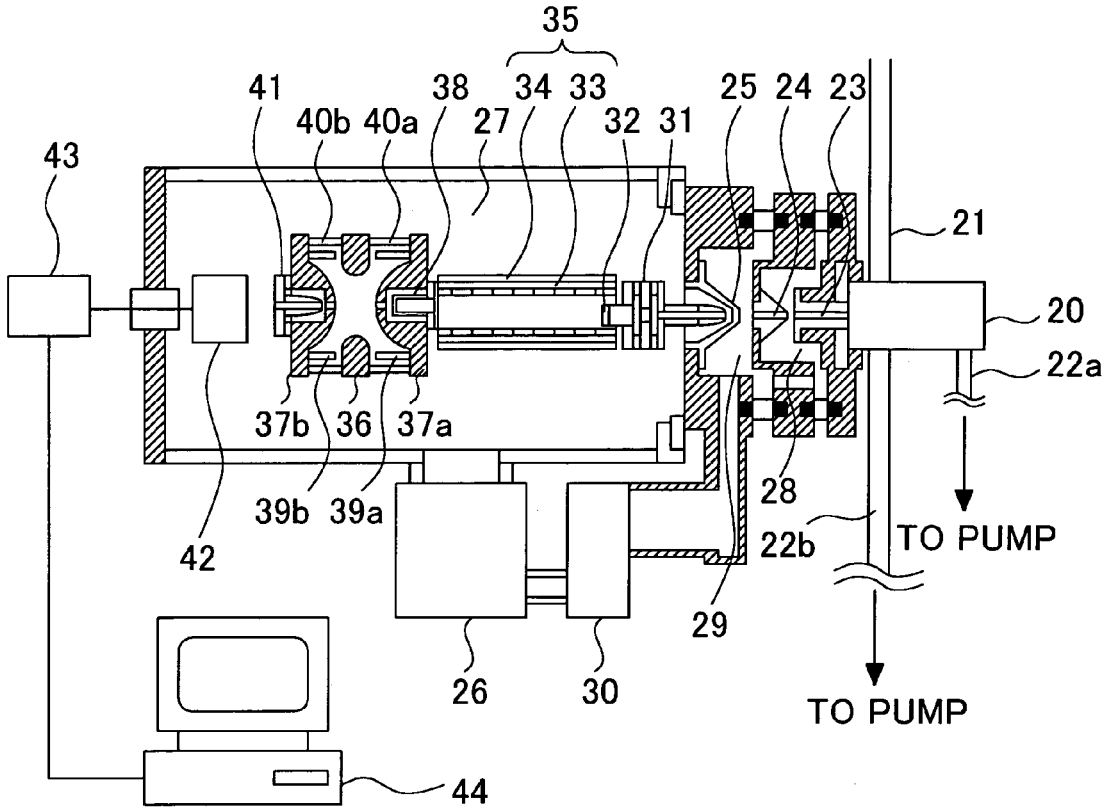
FIG. 1 is a view showing an example of a constitution for a dangerous material detection apparatus using a mass spectrometer having a quadrupole ion trap mass spectrometer in an embodiment according to the present invention.

FIG. 1 is a view showing an example for the constitution of a dangerous material detection apparatus using a mass spectrometer having a quadrupole ion trap mass spectrometer (hereinafter simply referred to as ion trap mass spectrometer) in an embodiment of the invention.

An ion source 20 is connected with a gas introduction tube 21, and exhaust tubes 22*a* and 22*b*. A gas from a sample gas collection port is sucked by a pump connected to the exhaust tubes 22*a* and 22*b* and introduced by way of the gas introduction tube 21 into the ion source 20. Ingredients contained in the gas introduced into the ion source 20 are partially ionized.

Ions generated from the ion source 20 and the gas introduced into the ion source are partially taken by way of a first aperture 23, a second aperture 24 and a third aperture 25 into a vacuum section 27 evacuated by a vacuum pump 26. Each of the apertures has a diameter of about 0.3 mm. The electrode in which the aperture is opened is heated to about 100° C. to 300° C. by a heater (not illustrated). The gas not taken from the first aperture 23 is exhausted by way of the exhaust tubes 22*a* and 22*b* to the outside of the apparatus by way of the pump.

Differential exhaust portion 28 (29) is defined between the electrodes in which the apertures 23, 24 and 25 are opened and evacuated by a general suction pump 30. While a rotary pump, a scroll pump or a mechanical booster pump is usually used for the general suction pump 30, a turbomolecule pump can also be used for the evacuation of this region. Further, a voltage can be applied to the electrodes in which the apertures 23, 24 and 25 are opened and improves the ion transmittance and, at the same time, cluster ions generated by adiabatic expansion are cleaved by collision with remaining molecules.

In FIG. 1, a scroll pump at an exhaust rate of 900 liter/min was used for the general suction pump 30 and a turbo molecule pump at an exhaust rate of 300 liter/sec was used for the vacuum pump 26 for exhausting vacuum section 27. The general suction pump 30 is used also as a pump for exhausting the back pressure side of the turbo molecule pump. The pressure between the second aperture 24 and the third aperture 25 is about 1 Torr (about 133.322 Pa). Further, the differential exhaust portion can also be constituted with two apertures, i.e., the first aperture 24 and the third aperture 25 while saving the electrode in which the second aperture 14 is opened. However, since the amount of entering gas increases more compared with the case described previously, it is necessary to consider a device, for example, of increasing the exhaust rate of the vacuum pump used for increasing the distance between the apertures. Also in this case, it is important to apply a voltage between both of the apertures.

The generated ions, after passing through the third aperture 25, are converged by a convergent lens 31. Einzel lens usually comprises three electrodes, etc. are used for the convergent lens 31. Ions further pass through a slit electrode 32. It is structurally adapted such that ions passing through the third aperture 25 are converged through the convergent lens 31 to the opening of the slit electrode 32 and passed therethrough but not convergent neutral particles, etc. collide against the slit portion and do not easily reach the mass analysis section. Ions after passing through the slit electrode 32 are deflected and converged by a double cylindrical deflector 35 comprising an inner cylindrical electrode 33 and an outer cylindrical electrode 34 having a number of openings. In the double cylindrical deflector 35, the ions are deflected and converged by using electric fields from the outer cylindrical electrode exuding through the openings of the inner cylindrical electrode. Details of the double cylindrical deflector are described in the prior art 4.

Ions after passing through the double cylindrical deflector 35 are introduced into an ion trap mass spectrometer constituted with a ring electrode 36 and endcap electrodes 37*a* and 37*b*. A gate electrode 38 is provided for controlling the incident timing of ions to the mass spectrometer. Flange electrodes 39*a* and 39*b* are provided in order to prevent the ions from reaching quartz rings 40*a* and 40*b* for holding the ring electrode 36 and the endcap electrodes 37*a* and 37*b* thereby charging the quartz rings 40*a* and 40*b*.

Helium is supplied to the inside of the ion trap mass spectrometer from a helium gas supply tube, not shown, and kept at a pressure of about $10^{-3}$ Torr (0.133322 Pa). The ion trap mass spectrometer is controlled by a mass spectrometer control section (not illustrated). Ions introduced into the mass spectrometer collide against the helium gas to loss the energy and trapped by an alternating electric field. The trapped ions are exhausted out of the ion trap mass spectrometer according to m/z of the ion by the scanning of a high frequency voltage applied to the ring electrode 36 and the endcap electrodes 37*a* and 37*b* and then detected by way of an ion take out lens 41 by a detector 42. The detected signal is amplified through an amplifier 43 and then processed by a data processing device 44.

Since the ion trap mass spectrometer has such a characteristic of trapping the ions at the inside thereof (in a space surrounded by the ring electrode 36 and the endcap electrodes 37*a* and 37*b*), trapped ions can be detected by taking the ion introduction time longer, even in a case where the concentration of the substances to be detected and the amount of generated ions is small. Accordingly, even in a case where the concentration of the sample is low, ions can be concentrated at a high ratio in the ion trap mass spectrometer and the pretreatment (such as condensation) of the sample can be simplified extremely.

Figure 2:
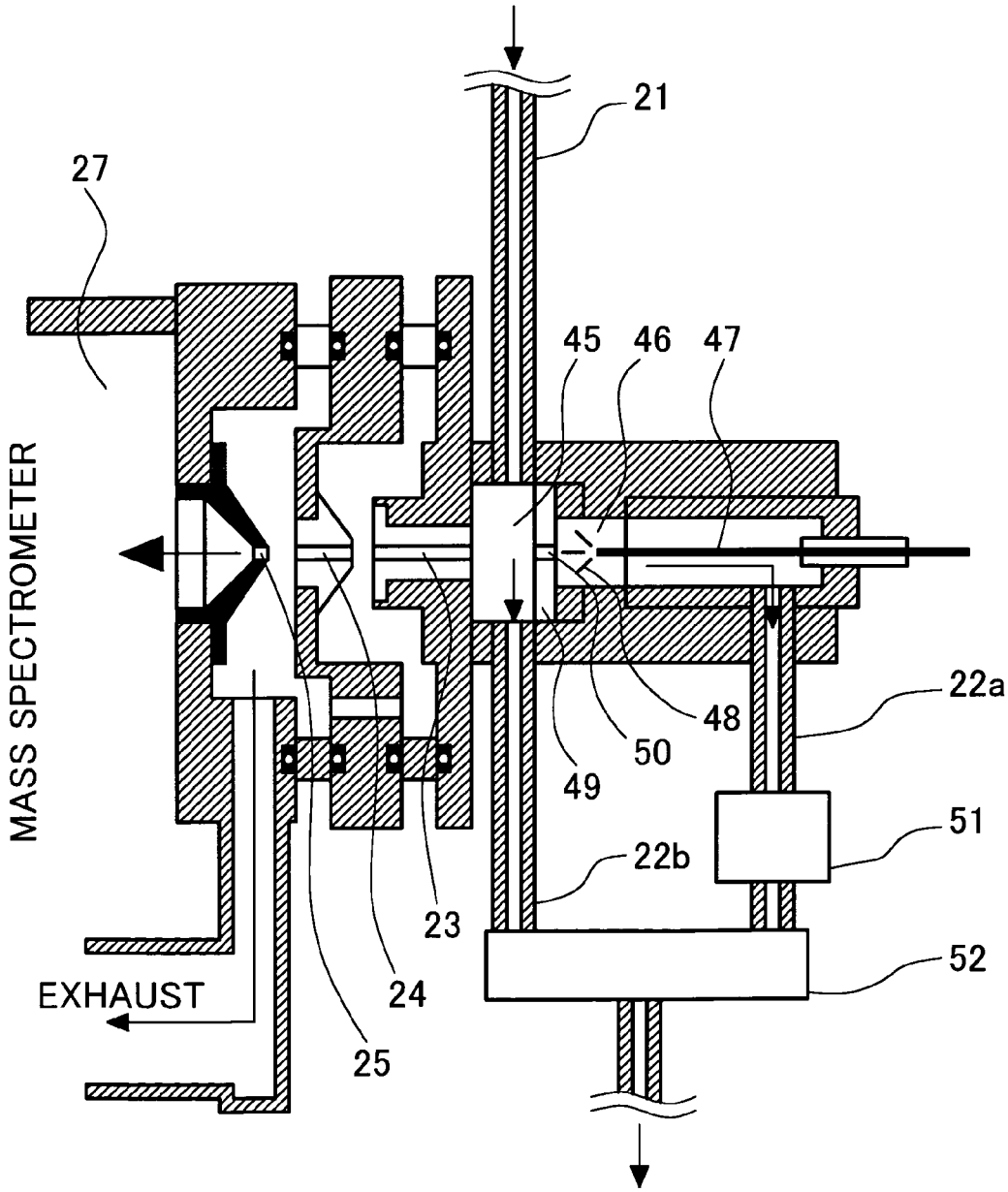
FIG. 2 is an enlarged view showing an example of the constitution for an ion source section in the apparatus shown in FIG. 1.

FIG. 2 is an enlarge view showing an example for the constitution of the ion source section in the apparatus shown in FIG. 1.

A gas introduced through the sample gas introduction tube 21 is once introduced to an ion drift section 45. The ion drift section 45 is at a substantially atmospheric pressure. A portion of the sample gas introduced into the ion drift section 45 is introduced into a corona discharging section 46, while the remaining gas is exhausted through the exhaust tube 22*b*. The sample gas introduced to the corona discharging section 46 is introduced to a corona discharging region 48 formed near the top end of a needle electrode 47 and ionized by applying a high voltage to needle electrode.

In this case, in the corona discharging region 48, the sample gas is introduced in the direction substantially opposed to the flow of the ions drifting from the needle electrode 47 to the counter electrode 49. The generated ions are introduced under the electric fields through the opening 50 of the counter electrode 49 to the ion drifting section 45. Then, the ions can be drifted and introduced efficiently to the first aperture 23 by applying a voltage between the counter electrode 49 and the electrode in which the first aperture 23 is opened. The ions introduced from the first aperture 23 are introduced through the second aperture 23 and the third aperture 25 into the vacuum section 27.

The flow rate of the gas flowing into the corona discharge section 46 is important for highly sensitive and stable detection. Accordingly, the exhaust tube 22*a* is preferably provided with a flow control section 51. Further, with a view point of preventing adsorption of the sample, the drifting section 45, the corona discharging section 46, the gas introduction pipe 21, etc. are preferably heated by a heater, not shown. While the flow rate of the gas passing through the gas introduction tube 21 and the exhaust tube 22*b* can be decided by the capacity of the suction pump 52 such as a diaphragm pump and the conductance of the pipeline, a control device like a flow control section 51 shown in FIG. 2 may also be disposed to the gas introduction tube 21 or the exhaust tube 22*b*. When the suction pump 52 is situated downstream to the ion generation section (that is, corona discharge section 46 for the illustrated constitution) in view of the gas flow, effects caused by contamination inside the suction pump 52 (adsorption of sample, etc) can be decreased.

Then, the operation of the ion trap mass spectrometer is to be described in details. The ion trap mass spectrometer is constituted with endcap electrodes and a ring electrode.

Figure 3:
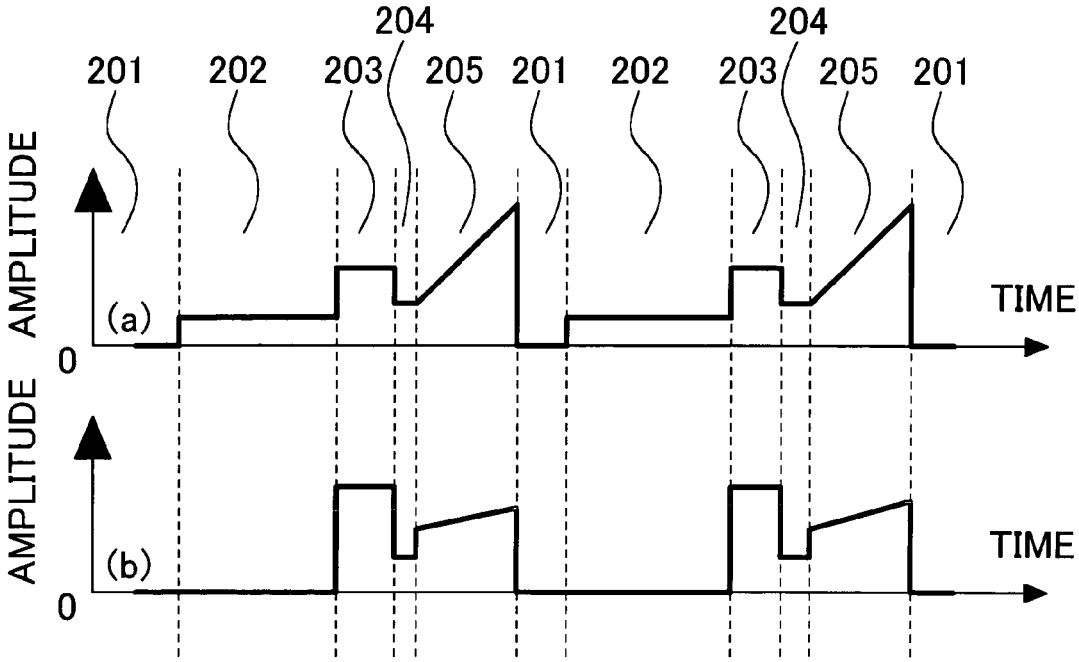
FIG. 3 is a chart for explaining the operation of the ion trap mass spectrometer in the embodiment according to the invention.

FIG. 3 is a graph for explaining the operation of an ion trap mass spectrometer in the embodiment of the invention. (a) in FIG. 3 is a graph showing the control with time for an amplitude of a high frequency voltage applied to the ring electrode and (b) in FIG. 3 is a graph showing the control with time for an amplitude of a voltage applied to the endcap electrodes.

At first, in an ion accumulation section 202, a high frequency voltage is applied to the ring electrode to form a potential for confining ions in a space surrounded with the ring electrode and the endcap electrodes. Further, a voltage is applied to the gate electrode is controlled such that the ions are introduced passing through the gate electrode into the mass spectrometer. The ions are incident from the opening in the endcap electrodes and trapped by the potential.

In the ion selection section 203, among various ions confined in the ion accumulation section 202, those ions having predetermined plural m/z are remained and other ions are discharges.

In the ion dissociation section 204, energy is given to the ions having plural m/z selected by the ion selection section 203, they are collided, for example, against a helium gas in the gas spectrometer to generate fragment ions. For giving the energy to the ions, a high frequency voltage is applied between the endcap electrodes to accelerate the ions in the mass spectrometer. The accelerated ions collide against the gas such as helium where a portion of the kinetic energy of the ions is converted to the internal energy of the ions, and internal energy is accumulated during repetitive collision and those portions with weak chemical bond in the ions are cleaved to cause dissociation.

In the mass analysis section 205, when the amplitude of the high frequency voltage applied to the ring electrode is increased gradually, orbits of the ions become instable sequentially from those with smaller values obtained by dividing the mass of ion with static charge of ion (hereinafter referred to as m/z) and they are exhausted through the opening formed in the endcap electrodes to the outside of the mass analysis section. The exhausted ions are detected by an ion detector.

After completion of the mass analysis section 205, the voltage applied to the ring electrode is removed and the ion confining potential is eliminated thereby removing ions remaining in the mass analysis section (remaining ion removal section 201). The series of operations described above are repeated.

Then, the ion selection method in the ion selection section 203 is to be described. While various methods can be adopted for discharging unnecessary ions and description is to be made to the method of using filtered noise fields (hereinafter referred to as FNF) described in the prior art 5. Ions accumulated in the ion trap mass spectrometer have inherent frequencies in accordance with m/z thereof. Accordingly, ions having specified m/z can be resonated and accelerated by applying the inherent frequency between the endcaps. The ions can be discharged selectively by controlling the amplitude applied to the endcaps. On the contrary, when a voltage having all frequency components (white noise) is applied between the endcaps, all the ions can be discharged in principle.

Then, when a noise not containing specific frequency components but containing other frequency components than described above (FNF) is applied between the endcap electrodes, it is possible to remain the ions having corresponding inherent frequency, that is, ions having specific m/z in the ion trap mass spectrometer and discharge other ions than described above.

Figure 4:
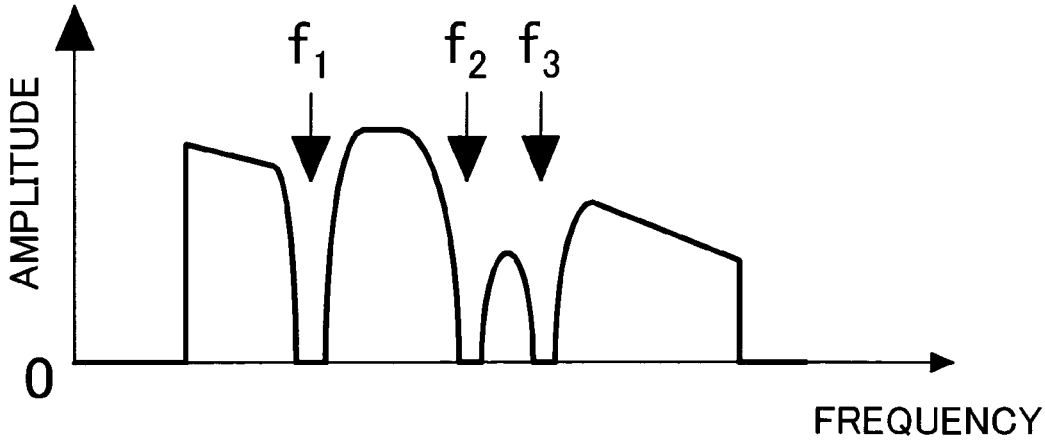
FIG. 4 is a chart showing an example for the frequency of a high frequency wave applied to endcap electrodes in an ion selection section.

FIG. 4 is a chart showing an example of a frequency of a high frequency wave applied to the endcap electrodes in the ion selection section, which shows the frequencies of the noise applied to the endcap electrodes in a case of using FNF. Assuming the inherent frequencies of the plural ions to be measured as f1, f2, and f3, a waveform not containing f1, f2, and f3 described above may be applied to the endcap electrodes.

In this case, the amplitude of the frequency to be applied is controlled on every frequencies in accordance with the physical property of the substance to be detected (easiness of dissociation, molecular weight, etc). At first, the easiness discharge differs depending on the mass of ion (exactly, a value obtained by dividing the mass with the static charge (m/z)), and a signal of a greater amplitude has to be applied for discharging more heavy ions. There exists a correlation between the mass and the resonance frequency of an ion and a heavier ion has lower resonance frequency. In view of the above, it is basically preferred to apply a signal of a greater amplitude as the frequency is lower.

Further, since the ion collides against a gas such as of helium in the mass analysis section, a deviation is caused from its original orbit. Thus, the resonance frequency inevitably has a variation to some extent. That is, the ion tends to be accelerated somewhat even at a frequency with a slight deviation. Although this provides no problem in usual chemical substances, a highly decomposing substance such as molecules of explosives may possibly collide to cause dissociation even when it is accelerated slightly. Accordingly, it is preferred to decrease the amplitude of the frequency as it approaches to the resonance frequency (f1, f2, f3).

Further, as shown at f2 and f3 in FIG. 4, in a case where their resonance frequencies are closer to each other, it is preferred to decrease the amplitude therebetween. On the contrary, in a case where an extremely intense signal of ion derived from impurities is contained, a signal of a greater amplitude may be applied between f1 and f2 in order to eliminate the impurity ions effectively.

Then, after remaining the ions having plural m/z in the mass spectrometer, the remaining ions are then dissociated simultaneously. In the ion dissociation section 204, energy is given to the ions having selected m/z in the ion selection section, colliding the ions against the helium gas or the like in the mass spectrometer, to generate fragment ions.

Figure 5:
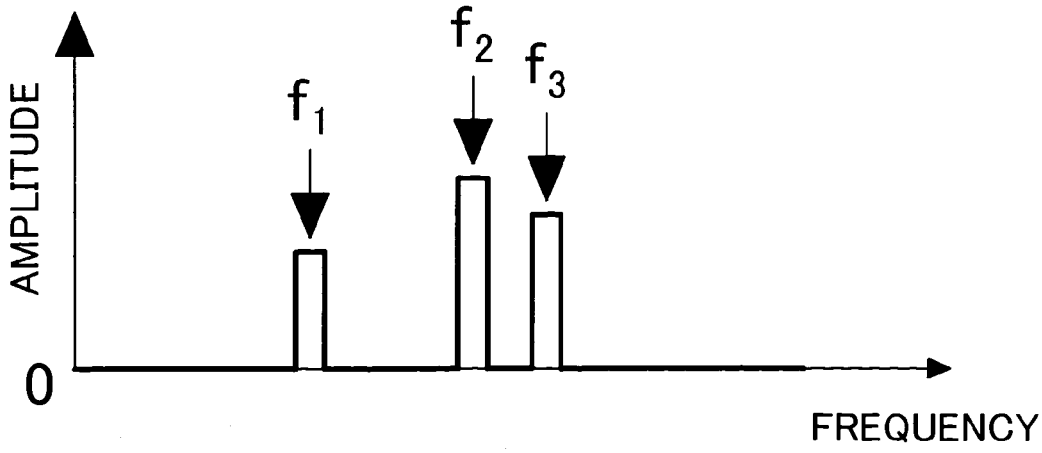
FIG. 5 is a view showing an example for the frequency of a high frequency wave applied to endcap electrodes in an ion selection section.

FIG. 5 is a chart showing an example of frequencies for a high frequency wave applied to the endcap electrodes in the ion dissociation section. The energy can be given to the ions by applying the inherent frequencies f1, f2 and f3 of the remaining ions between the endcap electrodes and accelerating the remaining ions in the mass spectrometer.

The amplitude suitable to the dissociation differs depending on the substance to be detected. For example, since a certain kind of explosives is highly dissociative, it may be sometimes disintegrated failing to obtain a fragment ion inherent to the compound when an amplitude at the some extent as that for other substances is given. Then, as shown in FIG. 5, it is preferred to change the amplitude of the signal applied in accordance with the substance to be detected.

The amplitude suitable on every frequencies shown in FIG. 4 and FIG. 5 is decided experimentally by using a substance to be detected. Further, since it is difficult to decide the effect of the impurity components until actual operation is conducted, it is effective to control the amplitude on every frequencies additionally based on the data obtained by practical operation.

Figure 6:
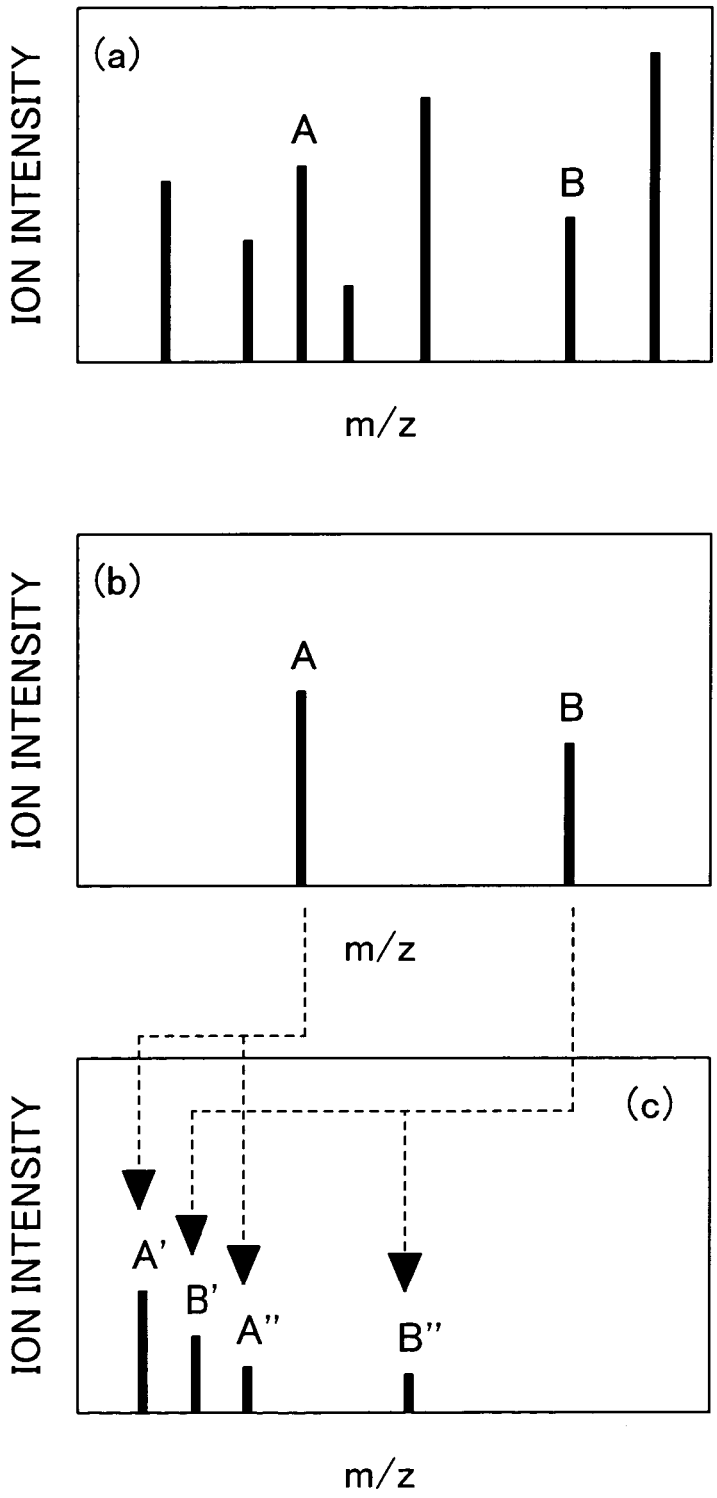
FIG. 6 is a chart showing an example of mass spectrum for explaining the effect of the invention.

FIG. 6 is a chart showing an example of a mass spectrum for explaining the effect of the invention more concretely. In FIG. 6, the abscissas expresses m/z and the ordinate expresses the ion intensity.

(a) in FIG. 6 is a chart showing a usual mass spectrum which shows a signal obtained by providing a mass analysis section after the ion accumulation section. (b) in FIG. 6 shows a signal obtained by providing the mass analysis section after the ion selection section, which corresponds to the mass spectrum of the precursor ion. It has a feature that plural precursor ions are present and each of A and B corresponds to m/z attributable to a predetermined explosive. (c) in FIG. 6 shows a mass spectrum conducting after tandem mass analysis simultaneously to the precursors A and B in which fragment ions A', A", B', and B" are detected.

Figure 7:
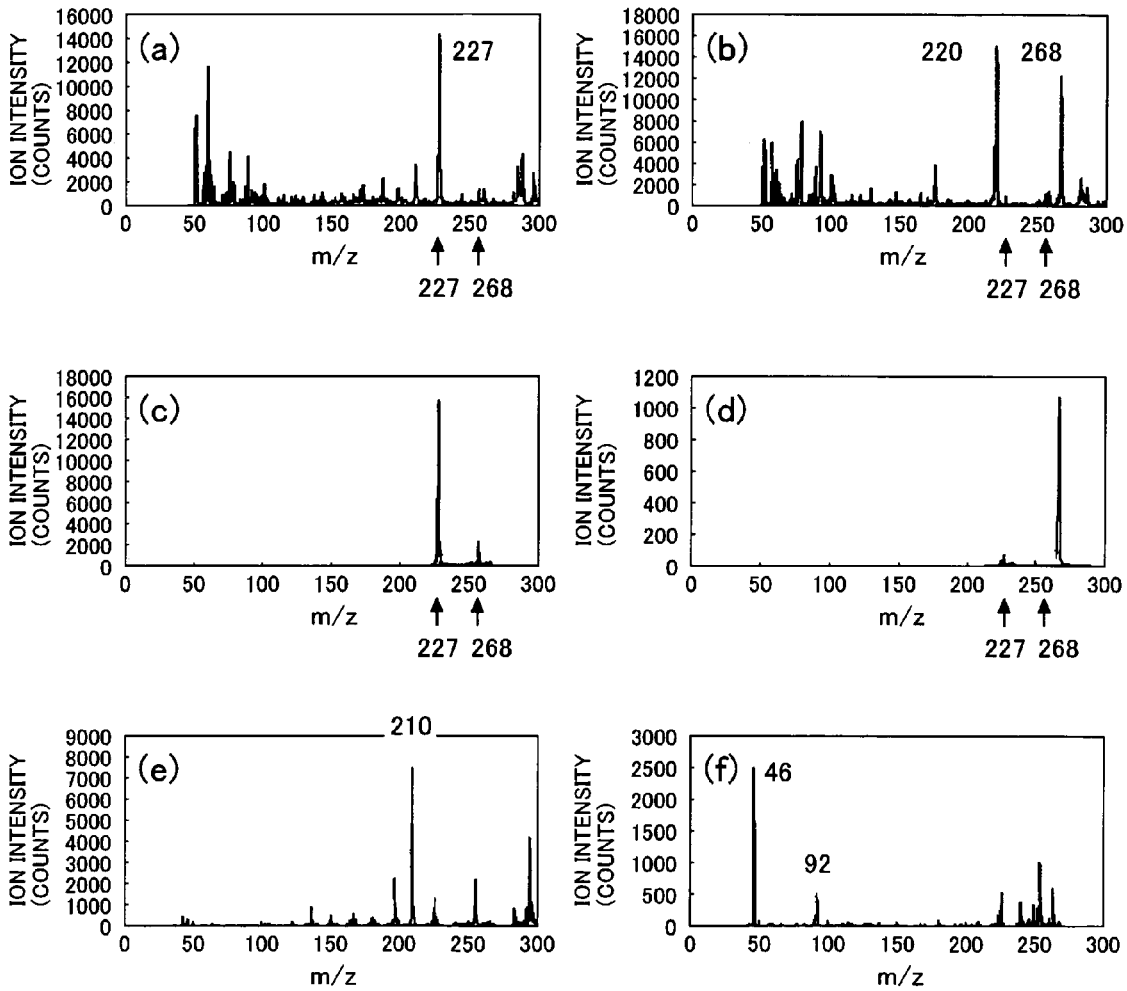
FIG. 7 is a chart showing an example of mass spectra in a case of conducting tandem mass analysis using TNT and RDX as typical explosives simultaneously in the embodiment according to the invention.

FIG. 7 are charts showing examples of mass spectra in a case of conducting tandem mass analysis by using TNT and REX as typical explosives simultaneously in the embodiment of the invention. In FIG. 7, the abscissa expresses the m/z value and the ordinate expresses the ion intensity.

At first, (a) in FIG. 7 shows a signal when TNT is introduced to the ion source. A characteristic signal is obtained at the position: m/z=227.

At first, (b) in FIG. 7 shows a signal when RDX is introduced to the ion source. A characteristic signal is obtained at the position: m/z=268. Then, for selecting m/z=227 and 268 simultaneously in the ion selection section and dissociating m/z=227 and 268 simultaneously in the ion dissociation section, frequencies applied to the endcap electrodes in each of the sections are selected and set. At first, a mass spectra after ion selection were obtained in order to confirm that the selections was conducted exactly.

(c) in FIG. 7 shows a signal when TNT is introduced into the ion source. Signals are obtained at the positions: m/z=227 and 268, in which an intense signal is observed at m/z=227, and it was confirmed that the ion derived from TNT was selected exactly.

(d) in FIG. 7 shows a signal when RDX is introduced into the ion source. Signals are obtained at the positions: m/z=227 and 268, in which an intense signal is observed at m/z=268, and it was confirmed that the ion derived from RDX was selected exactly. Then, mass spectra for the fragment ions obtained after ion dissociation were confirmed.

(e) in FIG. 7 shows a mass spectrum of a fragment ion when TNT was introduced to the ion source. A fragment ion derived from TNT dissociated from m/z=227 is observed at a position: m/z=210.

(f) in FIG. 7 shows a mass spectrum of a fragment ion when RDX was introduced to the ion source. A fragment ion derived from RDX dissociated from m/z=268 is observed at a positions: m/z=46 and 92.

As described above, the ion derived from TNT and the ion derived from RDX can be detected by the tandem mass analysis simultaneously, and when the signal of the fragment ion is judged and a signal is obtained at m/z=210, it may be judged that TNT has been detected and when a signal is obtained at m/z=46 or 92, it may be judged that RDX has been detected.

In a case of conducting the tandem mass analysis by the ion trap mass spectrometer, it usually takes 50 ms for the ion accumulation section, 20 ms for the ion selection section, 20 ms for the ion dissociation section, 50 ms for the mass analysis section and about 30 ms for the residual ion removal section, that is, about 0.2 sec of time is necessary for the measurement for once. In the existent tandem mass analysis, since one precursor ion is selected and dissociated, only one target could be detected in the measurement for once. Therefore, assuming the number of the kinds of explosives to be detected as 20, it requires about four sec of time and rapid detection was not possible. According to the invention, since the tandem mass analysis is conducted after selecting the plural precursor ions, the detection time can be shortened drastically while keeping high selectivity as it is.

In a case of detecting explosives or illicit drugs, even different substances may sometimes forms an identical fragment ion when tandem mass analysis is conducted. For example, while explosives often comprise nitro compounds, $NO_2^-$ and $NO_3^-$ derived from the decomposition of the nitro group are sometimes observed as fragment ions depending on the substance.

Figure 8:
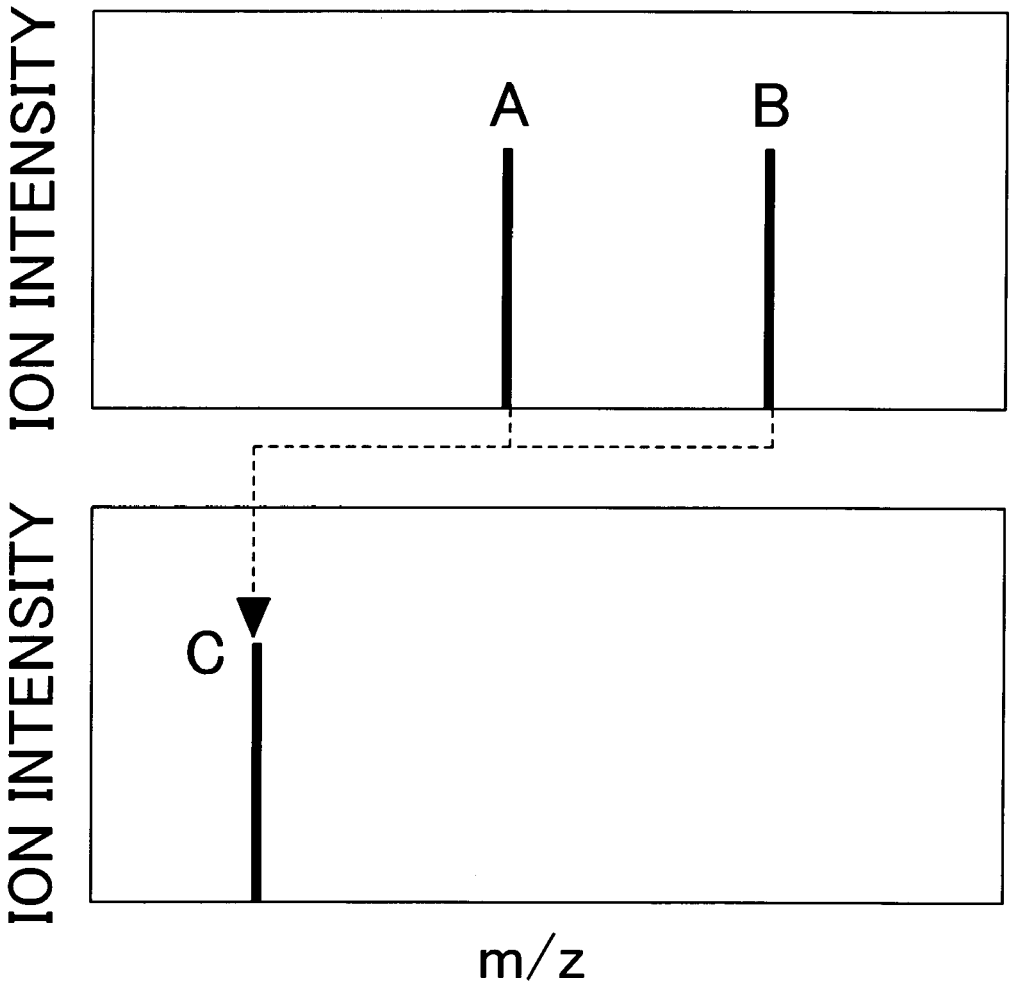
FIG. 8 is a view for explaining a case that different precursor ions generate identical fragment ions in the embodiment according to the invention.
Figure 9:
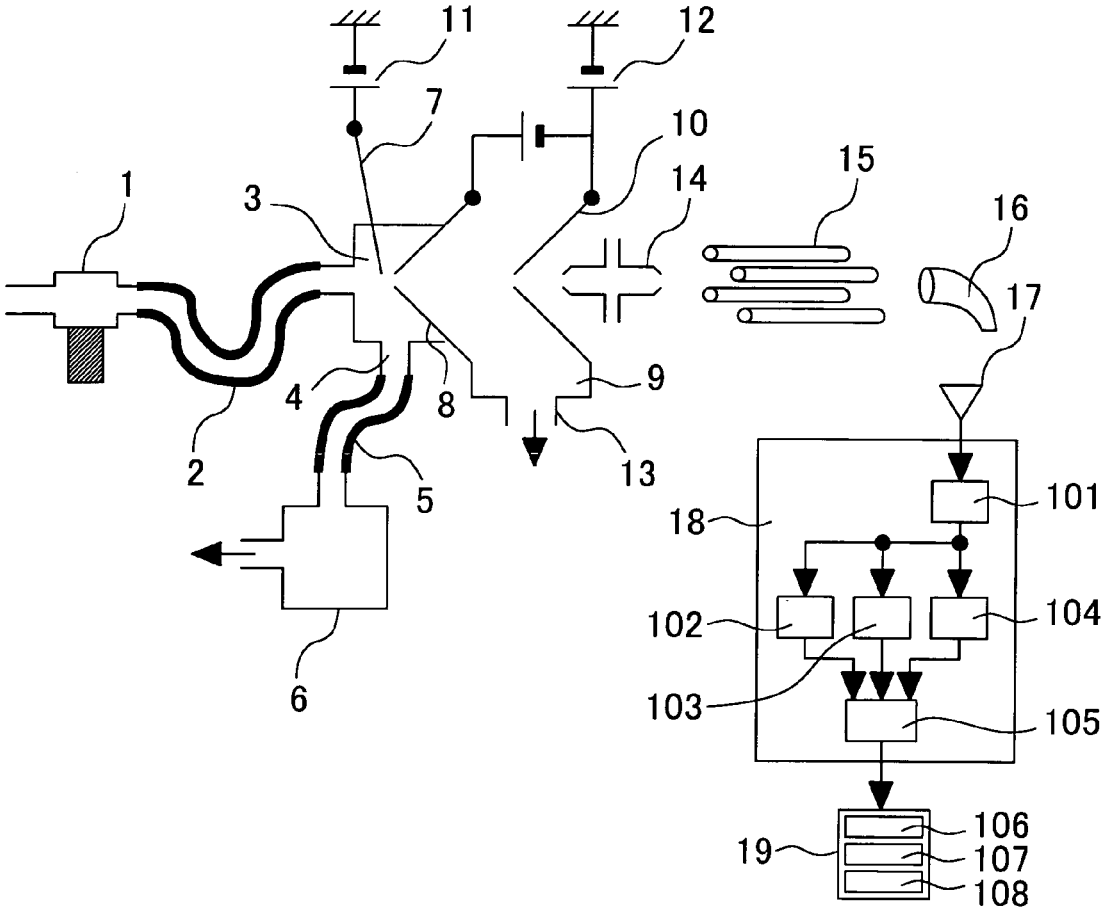
FIG. 9 is a view showing a constitution for a dangerous material detection apparatus of the prior art.

FIG. 8 is a view for explaining a case where different precursor ions form an identical fragment ion in the embodiment of the invention. In FIG. 8, the abscissa expresses the m/z value and the ordinate expresses the ion intensity. As shown in FIG. 8, in a case where both of different substances A and B form a fragment ion C, and the tandem mass analysis is conducted for A and B at the same time, it cannot be judged whether the original substance is A or B when the fragment ion C is detected.

In such a case, it is not advantageous to conducted tandem mass analysis for A and B, simultaneously and detection at higher accuracy is possible by separating measurement into a case of applying tandem mass analysis for plural targets including the substance A (measurement 1) and a case of applying tandem mass analysis for plural targets including the substance B (measurement 2) and conducting the analysis alternately.

Referring more specifically, the fragment ions of PETN as a sort of explosives include m/z=62 and the like, and the fragment ions having m/z=62 can be obtained also from other explosives, for example, nitroglycerine. Accordingly, when the tandem mass analysis is conducted to PETN and nitroglycerine simultaneously and detection is conducted based on the presence or absence of the fragment ion at m/z=62, it is difficult to distinguish a signal, when it is obtained, whether this is a signal derived from PETN or a signal derived from nitroglycerine. In a case where it is intended to judge as far as the kind of the explosives, it is preferred not to conduct the tandem mass analysis for PETN and nitroglycerine simultaneously but to conduct measurement separately or to measure the fragment ion inherent to each of the explosives as the target for measurement.

Further, in a case where the number of substances to be detected is increased and the relation between the precursor ion and the fragment ion becomes more complicated, three or more measuring conditions may be set previously and measurement may be conducted sequentially. For example, in a case where there are 20 kinds of targets to be detected measurement may be separated into measurement 1, measurement 2 and measurement 3 each for 7 to 8 ingredients and they may be measured sequentially such that the fragment ions are not overlapped based on the result of previous study. Assuming the time necessary for measurement for once as 0.2 sec, since the time necessary for conducting three steps of measurement is about 0.6 sec, a number of ingredients can be checked in a short period of time.

The present invention can be utilized to the improvement of security check in important facilities, for example, in airports.

What is claimed is:

1. A mass spectrometer, comprising:

a sample introduction section for introducing a sample;

an ion source for ionizing the sample introduced from the sample introduction section;

an ion trap mass spectrometer for mass spectrometry of ions generated from the ion source;

a data processing device having a data base for chemical substances and judging the presence or absence of an aimed chemical substance based on the mass spectral information obtained by the mass spectrometer;

a device for applying a high frequency signal not containing resonance frequencies for a plurality of precursor ions which have different m/z values from different chemical substances but containing resonance frequencies of other ions, and having different amplitudes set on every frequency to an electrode constituting the mass spectrometer thereby controlling the selection of the plurality of precursor ions which have different m/z values from different chemical substances; and a device for applying a high frequency signal having amplitudes set individually on every resonance frequency of the plurality of precursor ions which have different m/z values from different chemical substances and superimposed with the resonance frequencies for the plurality of precursor ions which have different m/z values from different chemical substances to the electrode constituting the mass spectrometer thereby controlling the dissociation of the plural precursor ions which have different m/z values from different chemical substances, being adapted for selecting the plurality of precursor ions which have different m/z values from different chemical substances, obtaining mass spectra of a plurality of fragment ions obtained by dissociating the selected plurality of precursor ions which have different m/z values from different chemical substances and judging the presence or absence of the aimed chemical substance based on the mass spectra of the obtained plurality of fragment ions.

2. The mass spectrometer according to claim 1, further comprising: means for switching previously registered plurality of analyzing conditions sequentially to conduct measurement.

3. A method for analyzing a chemical substance, comprising the steps of:

ionizing a sample;

trapping said sample in an ion trap;

selecting a plurality of precursor ions which have different m/z values from different chemical substances;

ejecting ions other than said selected ions out of said ion trap while said selected ions remain in said ion trap;

dissociating said selected ions; and analyzing mass spectra of said dissociated ions.

4. The method for analyzing according to claim 3, further comprising the step of:

switching a condition of selecting and dissociating based on a registered condition.

* * * * *